US006322381B1

(12) United States Patent
Evanisko

(10) Patent No.: US 6,322,381 B1
(45) Date of Patent: Nov. 27, 2001

(54) COLD CATHODE LAMP LAMPHOLDER WITH MAINS SWITCHING

(75) Inventor: Jim Evanisko, Hasbrouck Heights, NJ (US)

(73) Assignee: National Cathode Corp., Hackensack, NJ (US)

( * ) Notice: Subject to any disclaimer, the term of this patent is extended or adjusted under 35 U.S.C. 154(b) by 0 days.

(21) Appl. No.: 09/632,023

(22) Filed: Aug. 2, 2000

Related U.S. Application Data

(62) Division of application No. 09/129,018, filed on Aug. 4, 1998, now Pat. No. 6,099,336, which is a continuation of application No. 08/674,682, filed on Jul. 2, 1996, now abandoned, which is a continuation-in-part of application No. 08/517,912, filed on Aug. 22, 1995.

(51) Int. Cl.[7] ..... H01R 33/02
(52) U.S. Cl. ..... 439/231; 434/188; 315/187
(58) Field of Search ..... 439/226–244, 439/682, 683; 361/673, 674; 173/328; 313/318; 315/187, 315–362

(56) References Cited

U.S. PATENT DOCUMENTS 2,301,238 * 11/1942 Alm ..... 439/231
2,303,630 * 12/1942 Goddark ..... 439/233
4,643,504 * 2/1987 Knifer ..... 439/231

* cited by examiner

*Primary Examiner*—Hien Vu
(74) *Attorney, Agent, or Firm*—Schweitzer Cornman Gross & Bondell LLP

(57) ABSTRACT

A lampholder for use with cold cathode lamps intended to be wired in a parallel configuration includes an insulating bulb-end receptacle mounted in a conductor housing. The receptacle is divided into a pair of individual bulb-end receiving portions, each of which is provided with a conductive clip which establishes electrical contact with an inserted bulb. At least one of the clips is in two sections which are configured as switch contacts in series with the mains side of a ballast for the lamps. Insertion of a lamp into the clip closes the switch contacts, establishing the mains circuit and allowing high-voltage to be generated and applied to the lamps. The lampholder insures that high-voltage is not produced unless a lamp is in place.

2 Claims, 6 Drawing Sheets

COLD CATHODE LAMP LAMPHOLDER WITH MAINS SWITCHING

The present application is a Divisional application of Ser. No. 09/129,018 filed Aug. 4, 1998, now U.S. Pat No. 6,099,336, which is a continuation of Ser. No. 08/674,682 filed Jul. 2, 1996, now abandoned which a Continuation-in-part of Ser. No. 08/517,912 filed Aug. 22, 1995.

The present invention relates to a new and improved lampholder to be used with cold cathode lamps.

BACKGROUND OF THE INVENTION

Cold cathode lighting is used as an architectural lighting tool due to its great flexibility. Cold cathode lamps are generally in the form of elongated glass tubes filled with a luminescent gas which, when energized, emits a light of a particular color dependent upon the composition of the coating of the tube. Each end of the tube is provided with an electrode to allow the bulb to be connected into a lighting circuit by connection through bulb receptacles.

Such lamps may be arrayed either in a series or parallel ;circuit configuration. The series configuration requires a high voltage, typically in excess of 1000 volts, to be employed. The utilization of such a voltage level effectively prevents the use of a series lamp arrangement in certain locations. The National Electrical Code (NEC) prohibits the use of high voltage circuits in residential dwellings. In addition, the NEC prohibits the use of such high voltage circuits in an installation below 8'6" from ground or floor level.

A parallel circuit configuration for cold cathode lighting can operate at voltages below 1000 volts, and thus can be incorporated in locations where a series arrangement is prohibited. Particularly in residential dwellings, however, precautions must be taken to isolate or disable the still substantial (typically 990 volt) voltages to lessen the risk of contact with energized elements, particularly when a lamp is removed from a fixture and the electrical contacts are thus more fully exposed.

It is thus a purpose of the present invention to provide a new and improved lampholder for cold cathode lamps which may be utilized in connection with low voltage, parallel configuration lighting circuits, and which can be utilized as both a single and dual lampholder, allowing a variety of circuit configurations to be utilized.

It is a further purpose of the present invention to provide such a lampholder which incorporates a high voltage cutout which operates automatically upon removal of a lamp from the lampholder.

SUMMARY OF THE INVENTION

In accordance with the purposes and principles of the present invention, a cold cathode lamp lampholder is provided in the form of an outer conductive housing adapted to be interconnected with other housing and support elements in a manner by which a continuous ground may be provided for the lamp circuit. Mounted and electrically isolated within the conductive housing is an insulating lamp end receptacle having an internal recess dimensioned to accept a pair of cold cathode lamp electrode ends. The combination of the outer conductive housing and insulated lamp end receptacle create an internal wiring compartment therebetween which is sealed to prevent moisture entry. Split lamp electrode contacts are provided for at least one of the lamps within the insulated receptacle whereby each such contact consists of two conductive portions separated from each other and supported by an insulator. The contacts are further arranged in a manner which allows, as expressed through alternative embodiments of the invention, either independent or common electrical contact to be established with the electrodes by the lamp ends inserted therein, and which further permit a portion of the receptacle recess to be closed off when the receptacle is used with a single lamp, allowing the lampholder to be used with both single and dual lamp arrangements.

The split contacts of an electrode are wired in a series manner between power and a lamp ballast, power to the ballast and the creation of the high voltage occurring only when a lamp is inserted into the electrode, the conducting lamp end forming a series path between the electrode portions.

A fuller understanding of the present invention will be achieved upon consideration of the following detailed description of a preferred, but nonetheless illustrative embodiment of the invention, when reviewed in conjunction with the annexed drawings, wherein.

DETAILED DESCRIPTION OF THE INVENTION

Figures 8A, 8B:
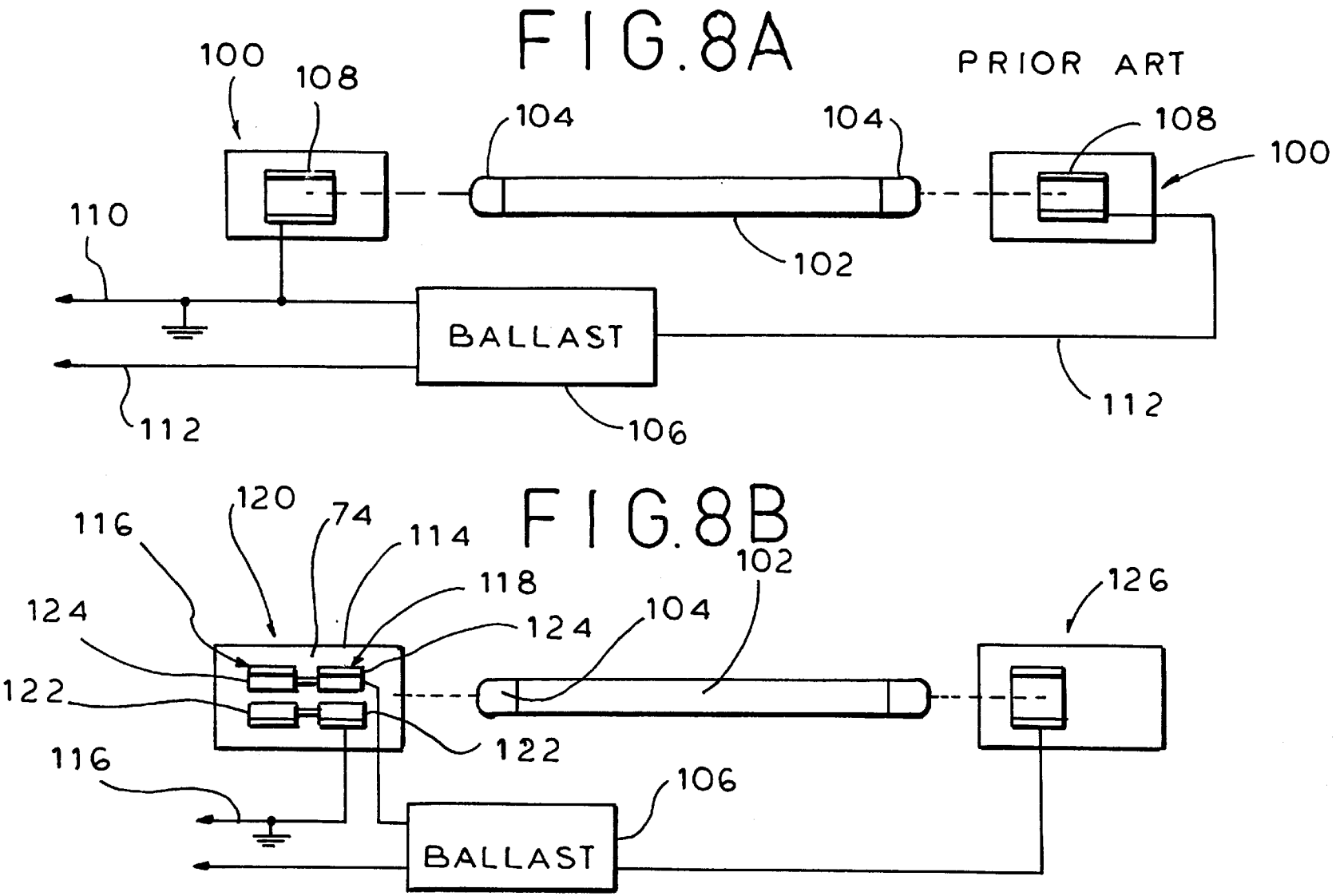
FIG. 8A is a diagrammatic representation of the wiring of a conventional lampholder.
FIGS. 8B–8D are diagrammatic representations of the wiring and operation of lampholders in accordance with the present invention.

Referring initially to FIG. 8A, a conventional circuit for a cold cathode lamp in a parallel configuration comprises a lampholder 100 at each end of the lamp 102. An electrode contact 108 within the lampholder contacts the electrode 104 at the end of the lamp, and provides high voltage alternating current to the lamp. A ballast 106, placed in series with the bulb, generates the necessary high voltage. The ballast is also connected to a source of line potential, the neutral side 110 of the line serving as a common for both the high voltage loop and the line voltage. As may be seen, the ballast is energized at all times, and thus the lampholder electrode contact connected to the high side line 112 of the ballast is at high potential, so long as line current is applied to the system.

As depicted in FIG. 8B, which is a schematic representation of a first lampholder circuit construction within the scope of the present invention, a lampholder constructed in accordance with the present invention provides for automatic isolation of the ballast, and thus cutout of high voltage, when the lamp 102 is removed. As depicted therein, first lampholder 114, shown as intended to receive two lamps in a parallel circuit configuration, includes an electrode contact assembly 116 adapted to engage the end electrode of two lamps. The contact assembly 116 has a first contact 118 to engage a first lamp and a second contact 120 to engage a second lamp. Each of the contacts 118, 120 has a first part 122 electrically connected to the neutral side of the input line. A second part 124 of each contact is electrically connected to the ballast 106. The two parts of each contact are electrically isolated from each other. With no lamps inserted into the lampholder, no return is provided for ballast 106. Thus the ballast is not energized and no high voltage is produced.

With the insertion of a lamp, however, the conductive lamp electrode 104 electrically joins the two contact parts 122, 124.

With this connection established, a return path is provided for the ballast line voltage and the ballast is energized, providing high voltage for lamp energization. The lamp then operates in the normal manner. When the lamp is removed, the ballast is again isolated and de-energized, removing the high voltage from the distal lampholder. As shown in FIGS. 8B, insertion of either lamp will energize the ballast.

With general reference to FIGS. 1–5, a cold cathode lampholder 10 constructed in accordance with the present invention comprises shell or box 12, typically formed of steel or aluminum, as known in the art. The box walls may be provided with one or more scored or partially cut areas 14, best seen in FIG. 2, to allow the attachment of connecting components, such as the end of a section of conduit 16, which is typically mounted to a box wall by the use of a pair of nuts 18. The top of the box is open, and is provided with a pair of opposed ledges 20 having threaded bores 22 to allow the mounting of components upon the open face. As shown, the box is provided with a cover plate 24, typically of planar dimension somewhat larger than the top dimensions of the box 12. The cover plate 24 has a central aperture 26 to allow mounting of an insulated lamp end receptacle 28, as known in the art. Upon assembly, the combination of box, cover plate and receptacle is sealed to provide a moisture-resistant housing for connecting leads between the receptacle and the lighting system wiring.

Figure 3:
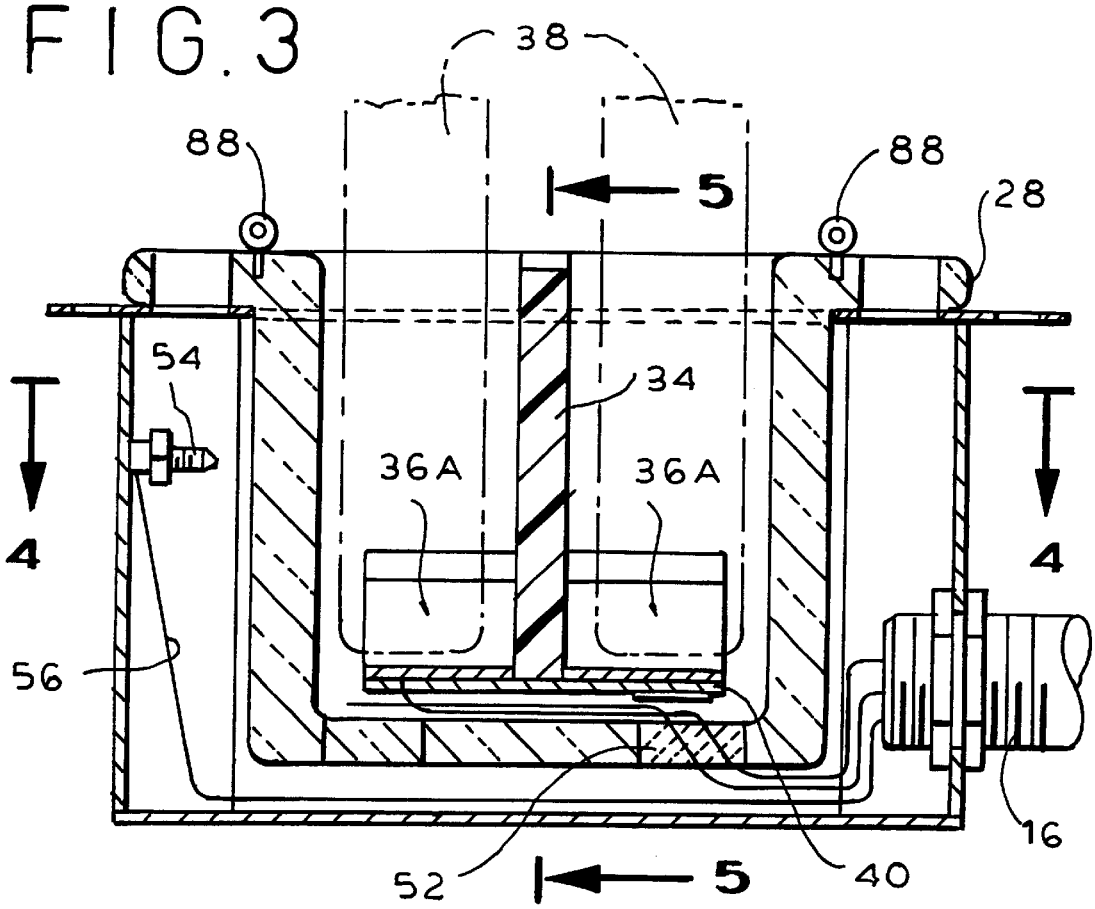
FIG. 3 is an elevation view in section take along line 3—3 of FIG. 1.
Figure 4:
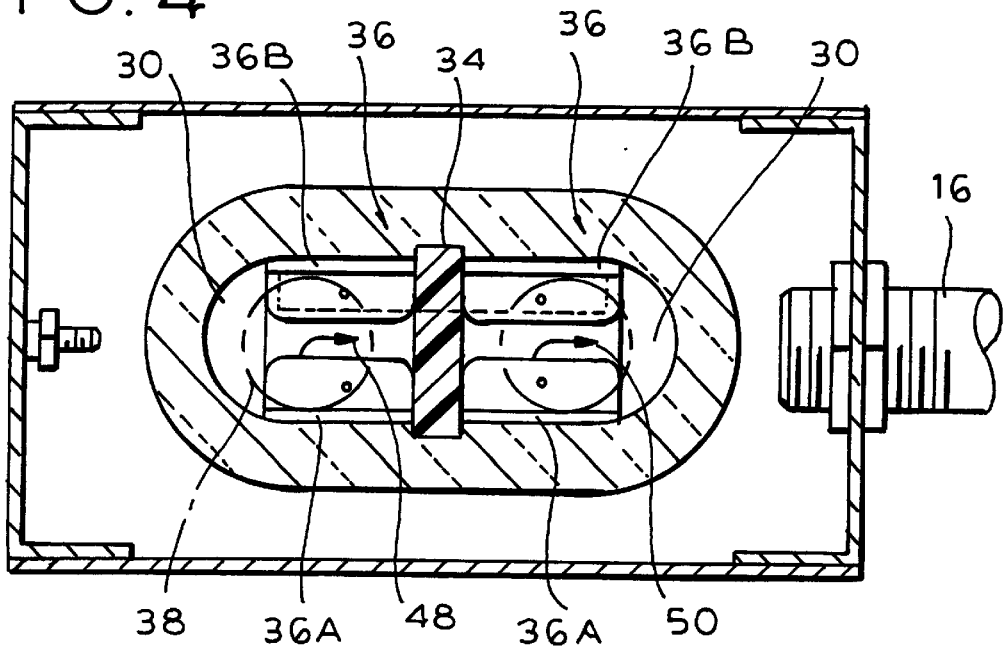
FIG. 4 is a top plan view in section taken along line 4—4 of FIG. 3.

In a first embodiment, as presented in FIGS. 1 through 5 and FIG. 8D, and which requires both lamps to be inserted into the lampholder, the receptacle 28 includes a lamp end receiving aperture 30, which is generally rectangular in plan, with arcuate ends, as best seen in FIG. 4, which is dimensioned to accept the electrode ends of a pair of cold cathode lamp tubes aligned in parallel. The opposed parallel sides of the aperture are each provided with an aligned, vertically-extending notch or slot 32, extending the depth of the aperture 26, and which accepts an insulating divider plate 34 formed of phenolic or other insulating material, which may be permanently mounted within the aperture by use of an appropriate adhesive, such as epoxy.

Figure 5:
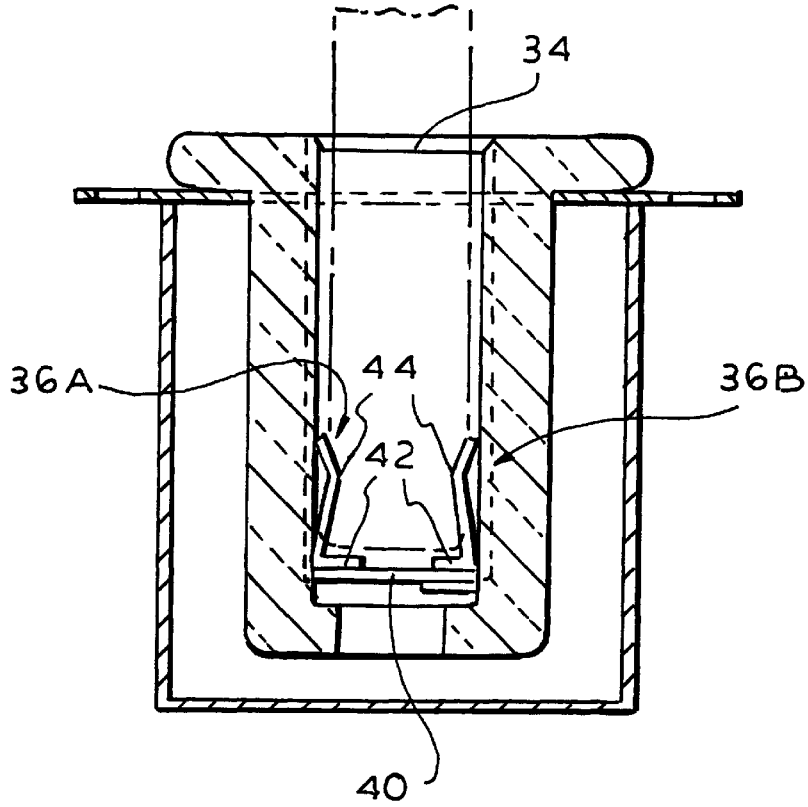
FIG. 5 is an end elevation view in section taken along line 5—5 of FIG. 3.

The lower end of divider plate 34 rests upon, and may be affixed to, insulating base 40, which may be formed of a urea-based or other composite, which in turn supports a pair of copper electrode clips 36, each dimensioned to accept and firmly grasp the exposed electrode end of a cold cathode lamp 38, shown in phantom in FIGS. 3 and 4. Each of the clips 36 is in two parts, 36A and 36B, each of which comprises a base portion 42 which may be secured to the insulating base 40 by a rivet or other connector and an upward extending side 44 to engage the lamp electrode. The bases of the clip sections 36A and 36B are electrically isolated from each other upon the insulating base 40. The clip sides 44 may include an inward bias or bend, as best seen in FIG. 5, to provide a degree of flexure and tension between the clip sides and the inserted lamp.

The parts 36B of the two clips 36 are electrically joined together by a jumper 46, which may be located on the bottom of the insulating base 40 and is connected to the parts 36B by the rivets which mount the parts 36B to the insulating base. A pair of leads 48, 50 as shown in FIG. 4, extend from the parts 36A of the clips 36 through an aperture 52 in the bottom of the receptacle 28 for connection to the ac mains neutral and the ballast 106, as shown in FIG. 8D, the receptacle being designated by reference 128. The aperture 52 is sealed with a silicone insulating compound as known in the art. The insulating compound may be further utilized as an adhesive to maintain the insulating base and mounted clips in position within the receptacle 28. A ground stud 54 may be provided upon the interior of the box 12, and allows a ground lead 56 to be run as required through the connecting conduits 16. The construction may be completed by the inclusion of additional silicone beads and/or other appropriate sealants, as known in the art, to seal all apertures or holes the completed structure to prohibit moisture entry.

In use, the lampholder may be utilized with a non-interrupting lampholder 134 as known in the art to provide the required circuit loop for the high voltage through the lamps as denoted in FIG. 8D. While the lampholder 134 has provision for two lamps, it is to be recognized that a second independent lampholder for the second lamp inserted into invention lampholder 128 may be provided. It is to be further appreciated that removal of either of the two cold cathode lamps opens the primary ballast circuit, thus cutting out the high voltage from the distal lampholders.

Figure 6:
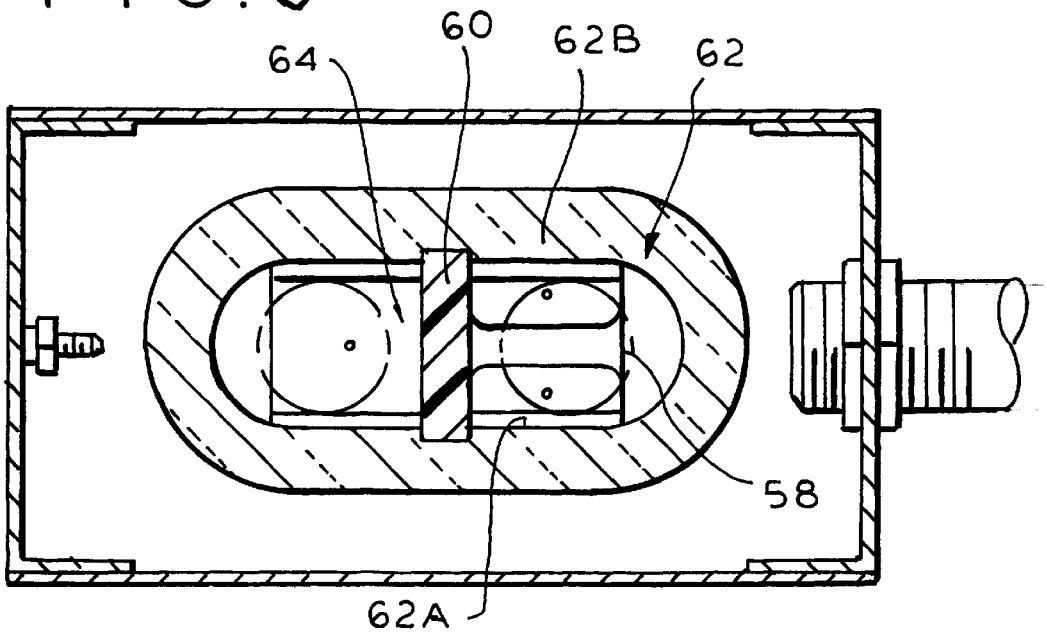
FIG. 6 is a top plan view in section taken along a line equivalent to line 4—4 in FIG. 3 representing a first alternative embodiment for the invention.
Figure 8C:
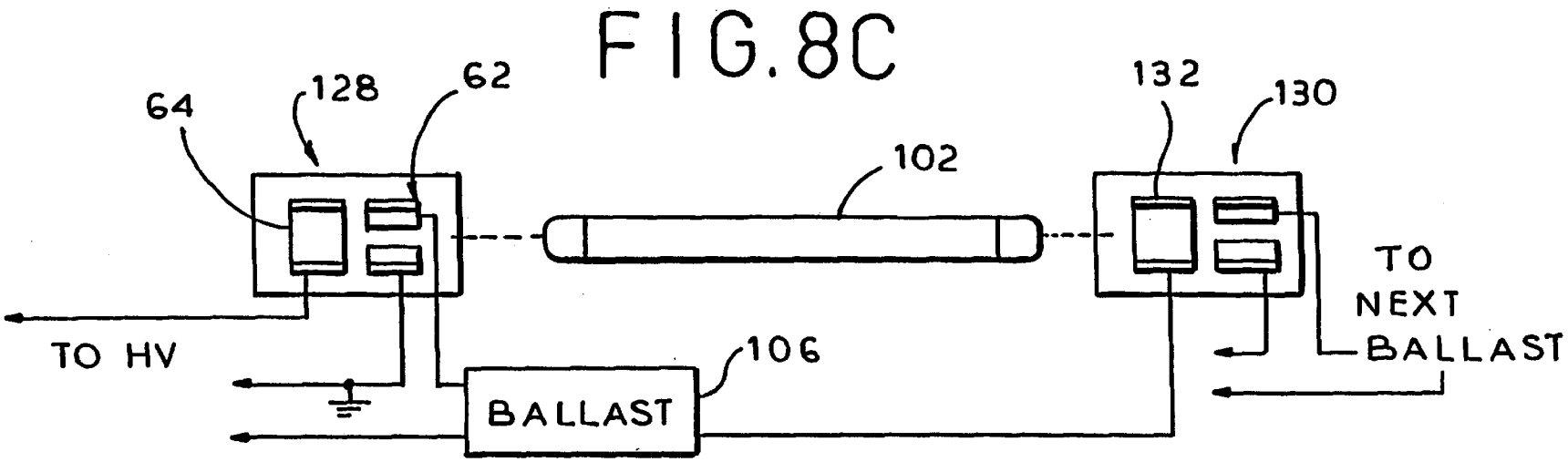
Figure 8D:
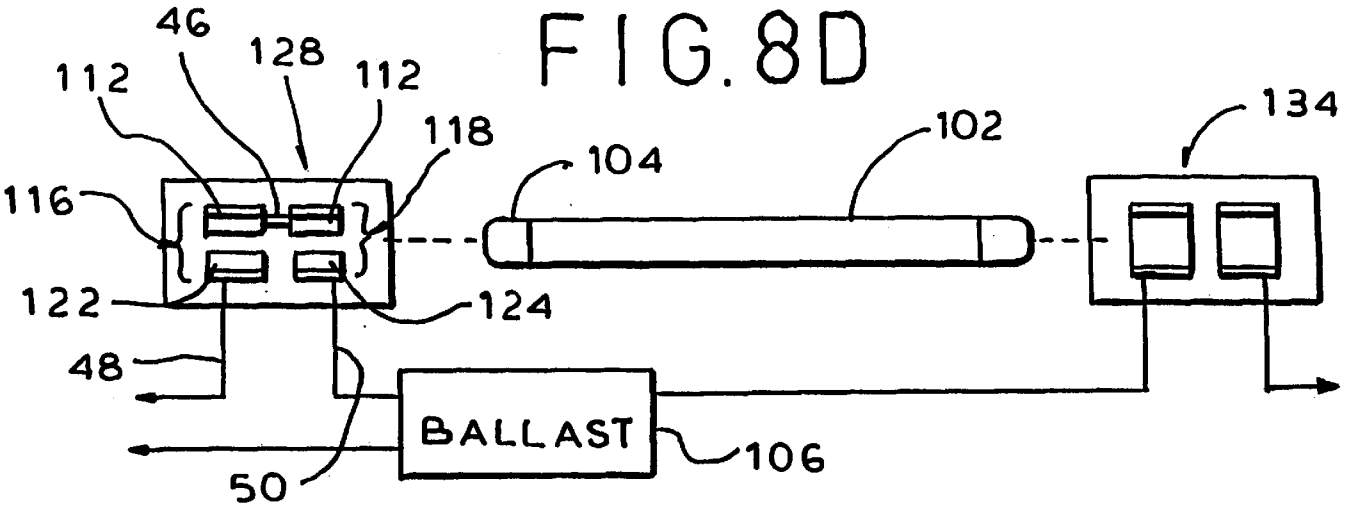

In an alternate embodiment, detailed in FIG. 6, the lampholder is configured for use in a string arrangement of lamps, where the lampholder provides a line neutral connection in a first lamp circuit and a high voltage connection in a second lamp circuit, as shown schematically in FIG. 8C. As shown in FIG. 6, the insulating base 58 supports, on one side of the divider 60, first lamp electrode clip 64, which is of conventional U-shaped construction to engage a lamp end electrode. The other electrode clip 62 is of split construction, with separated parts 62A and 62B. This construction is wired as depicted in FIG. 8C, whereby the conventional clip 64 is connected to a high voltage lead of a first ballast (not shown) in a first lamp circuit, while the split clip 62 is wired into the neutral leg of the line side of the ballast 106 utilized with the lamp 102. Until the lamp 102 is inserted into the clip 62 the clip 132 in distal lampholder 130 is not energized. The lampholder 130 may itself be of the inventive nature of the present invention, similarly wired to provide isolation of the next lamp of the string. Such a configuration allows a series of lamps and sockets to be utilized in conjunction with the isolation benefits of the present invention. Of particular benefit in the construction of FIG. 6 is that the clips for the two lamps are fully isolated from each other by central divider 62, such that when one lamp is removed, the other circuit is not exposed.

Figure 1:
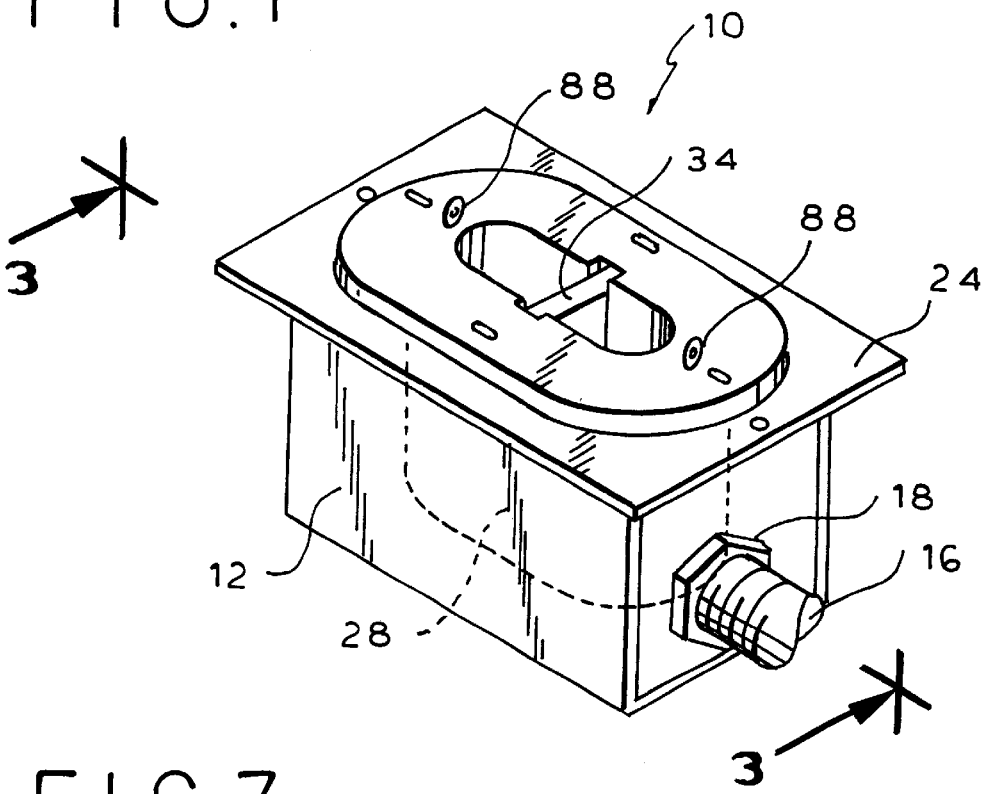
FIG. 1 is a perspective view of a lampholder in accordance with the present invention.
Figure 7:
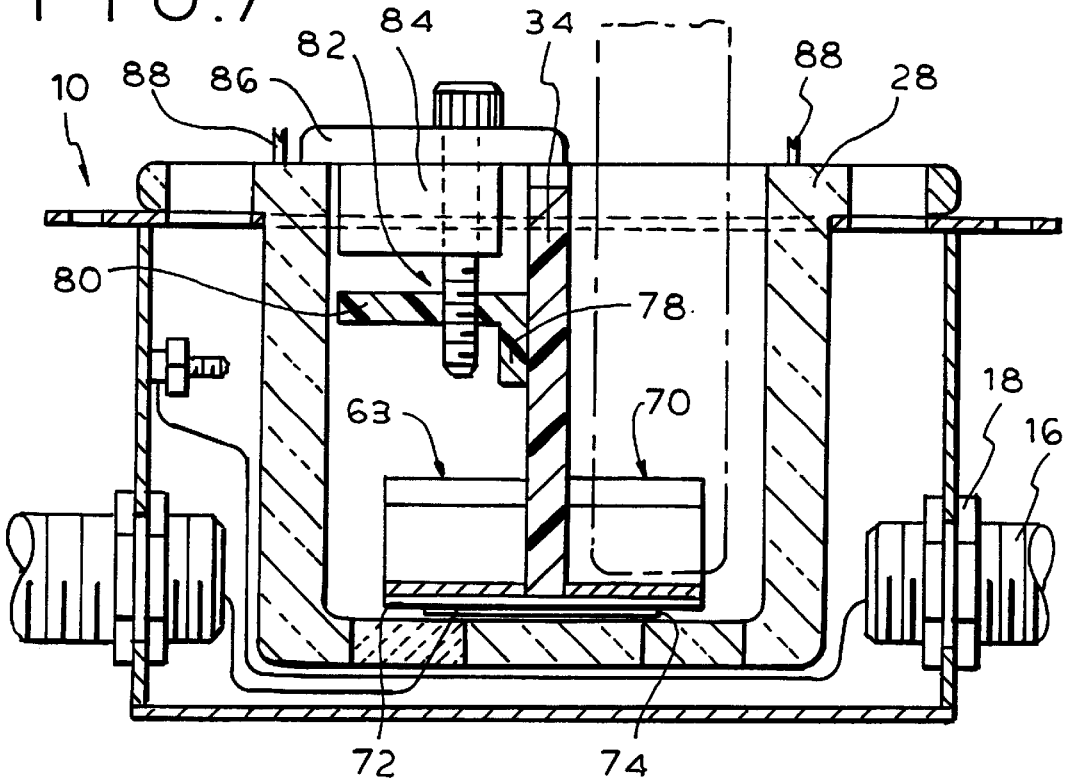
FIG. 7 is an elevation view in section taken along a line equivalent to line 3—3 of FIG. 1 showing a second alternative embodiment.
Figure 2:
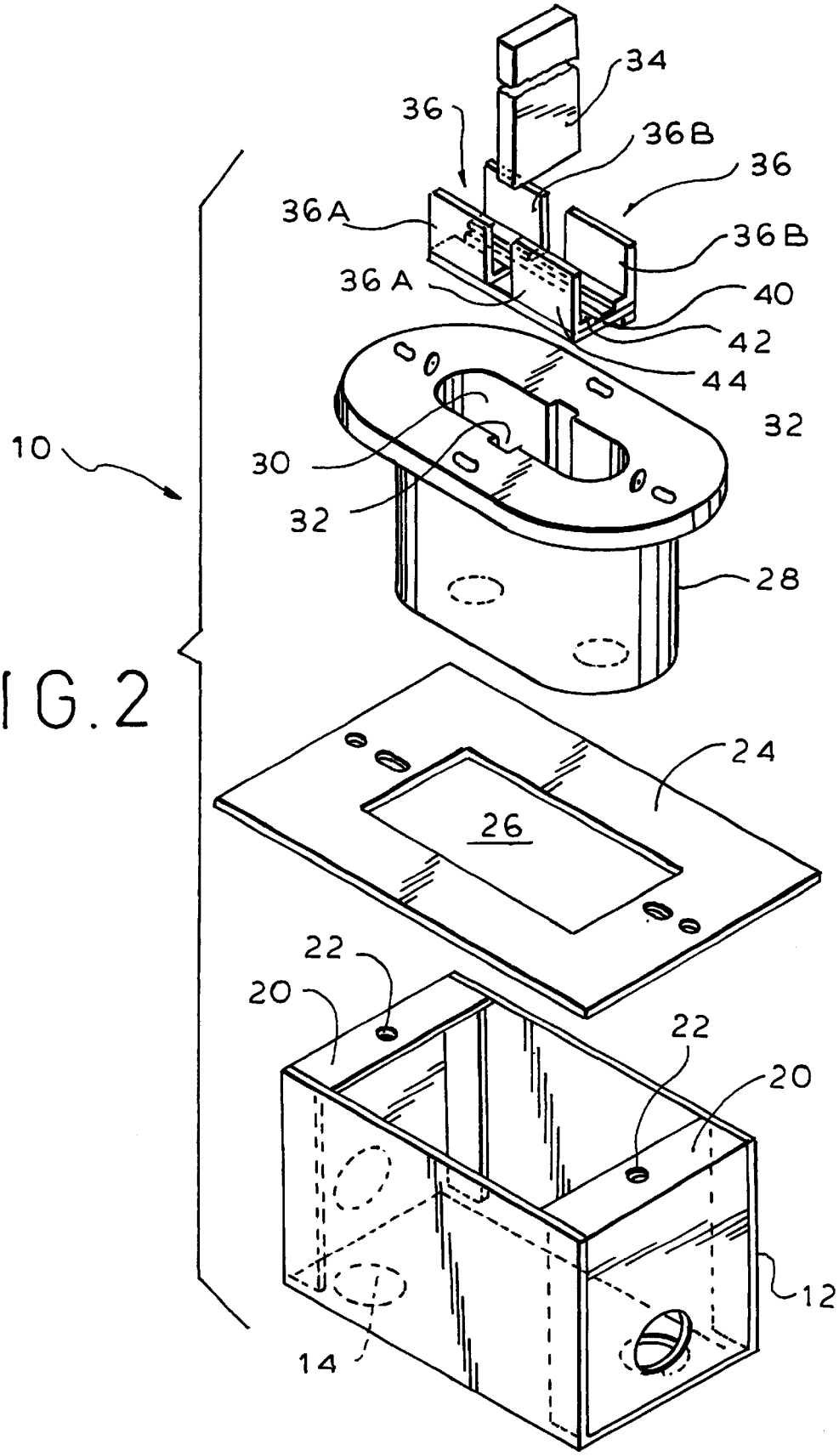
FIG. 2 is an exploded perspective view thereof.

As depicted in FIG. 7, in a third embodiment of the present invention the lampholder 10 is adapted to accept either one or two lamps, wherein removal of one lamp will not disrupt the current high voltage while removal of both lamps will. This configuration, represented schematically by FIG. 8B, provides a lampholder which can accommodate either one or two bulbs on the same ballast. As shown in FIG. 7, each of the lamp electrode clips 68, 70, corresponding respectively to first and second portions 118, 120 of contact assembly 116 in FIG. 8B, are split into first and second portions 122, 124. The clips are mounted on insulating base 72, and are insulated from each other by divider 34. The two respective parts of each of the clips are electrically connected by the jumpers 74, located upon the bottom surface of the base 72 and joined to the clip portions by the rivets holding the clips to the base. The part pairs are each provided with a lead to allow wiring in the neutral leg of ballast 106 in accordance with FIG. 8B.

To allow conversion from double to single lamp use, means are provided to block the portion of the access opening in the receptacle 28 which would otherwise expose the non-utilized electrode clip. Accordingly, a bracket 76 may be provided within the portion of the interior of the receptacle associated with the unused lamp-accepting portion. The bracket 76 may take the form of an L-shaped construction, the leg 78 of which may be affixed to the divider 34, while the perpendicular arm 80 presents a threaded bore 82 perpendicular to the open end of the receptacle 28. An insulating bolt or other elongated element 84, having mating threads at its distal end and an enlarged head is provided, and maintains an insulating cover plate 86 in place upon the top of the receptacle 28 over the partial entranceway defined by the sides of the receptacle and the divider plate. The enlarged head of the bolt applies downward pressure upon the cover about a provided throughbore for the bolt. Thus configured, the lampholder may accept a single lamp for engagement with the electrode clip 70, while shielding the clip 68 from the environment. The bracket may be permanently affixed to the divider, in which case it can be cut to convert the lampholder from one bulb to two bulb use, or it may be removable, which would allow conversion between one and two bulb use without preventing a subsequent second conversion.

A pair of eyes 88 may be provided on the receptacle top surface in each of the embodiments to provide attachment points for strings which may be used to encircle or otherwise restrain installed lamps to provide additional protection against the bulbs falling out of the receptacles.

As disclosed herein, the present invention provides for a new and unobvious lampholder which allows for automatic current shutoff when a lamp is removed, and further having the ability to be configured for both single and dual lamp operation of cold cathode lighting circuits when such lamps are arranged in a parallel configuration. As so designed, it permits such cold cathode lighting, and its attendant advantages, to be utilized in environments where series circuits, or parallel configurations in which a lampholder remain energized upon lamp removal would be unacceptable.

I claim:

1. A lampholder for cold cathode lamps each lamp having an electrode at each opposite end of the lamp, said lampholder comprising:

a conductive shell having a metal cover plate supporting a ceramic lamp end receptacle housing having an aperture to accept the electrode at one end of a first lamp and the electrode at one end of a second lamp, said conductive shell, metal cover plate and ceramic housing being sealed to provide a moisture-resistant housing;

a first electrical contact for engaging the electrode of the first lamp and a second electrical contact for engaging the electrode of the second lamp, said first and second electrical contacts being attached to an insulating base, said first and second electrical contacts and said base being mounted within the ceramic housing, said first and second electrical contacts each comprising a first and a second section, said first and second sections being electrically isolated from each other by a space and located to contact separate conductive portions of the respective electrode;

one of said first sections of the first and second electrical contacts being connected to a neutral side of an input line, and the other of said first section of the first second electrical contacts being electrically connected to a ballast for the lamps, said second section of the first and second electrical contacts forming a series pair of primary side switch contacts for the ballast which are electrically joined and the ballast energized when the respective electrodes are engaged with the first section and the corresponding second section.

2. The apparatus of claim 1 further comprising an insulated divider within said ceramic housing having a lower end in contact with said insulating base to divide said ceramic housing into first and second lamp-receiving chambers.

* * * * *